US009617123B2

(12) United States Patent
Meyer

(10) Patent No.: US 9,617,123 B2
(45) Date of Patent: Apr. 11, 2017

(54) METHOD AND SYSTEM FOR LIFTING AND MANIPULATING A LOAD

(75) Inventor: William Meyer, Sugar Land, TX (US)

(73) Assignee: AMEC FOSTER WHEELER USA CORPORATION, Houston, TX (US)

( * ) Notice: Subject to any disclaimer, the term of this patent is extended or adjusted under 35 U.S.C. 154(b) by 428 days.

(21) Appl. No.: 13/435,804

(22) Filed: Mar. 30, 2012

(65) Prior Publication Data

US 2012/0325765 A1 Dec. 27, 2012

Related U.S. Application Data

(60) Provisional application No. 61/470,600, filed on Apr. 1, 2011.

(51) Int. Cl.

| | |
|---|---|
| ***B66C 17/00*** | (2006.01) |
| ***B66C 13/08*** | (2006.01) |
| ***B66C 23/00*** | (2006.01) |
| ***B66C 1/10*** | (2006.01) |

(52) U.S. Cl.

CPC ..... *B66C 17/00* (2013.01); *B66C 1/10* (2013.01); *B66C 13/08* (2013.01); *B66C 23/00* (2013.01)

(58) Field of Classification Search

USPC ..... 212/312, 315, 319, 320–323, 324, 270, 212/331; 104/96, 98; 191/22 R, 29 R, 30, 191/31, 32

See application file for complete search history.

(56) References Cited

U.S. PATENT DOCUMENTS

| | | | | |
|---|---|---|---|---|
| 532,321 | A | 1/1895 | Gates | |
| 1,835,357 | A * | 12/1931 | Townsend | B66C 7/00 212/116 |
| 1,869,421 | A * | 8/1932 | Harris | B66C 7/00 104/98 |
| 2,316,064 | A | 4/1943 | Hans | |
| 2,486,222 | A | 10/1949 | Spafford | |
| 2,941,674 | A | 6/1960 | Bille | |
| 3,111,228 | A * | 11/1963 | Anderson | 212/335 |
| 3,297,170 | A * | 1/1967 | McCready et al. | 212/316 |
| 3,854,592 | A | 12/1974 | Mordre | |
| 4,106,641 | A | 8/1978 | Campbell et al. | |
| 4,144,974 | A | 3/1979 | Longthorpe | |
| 4,350,254 | A | 9/1982 | Noly | |

(Continued)

FOREIGN PATENT DOCUMENTS

| | | |
|---|---|---|
| GB | 2304681 A | 3/1997 |
| JP | H09278356 | 10/1997 |
| SU | 694447 A1 | 10/1979 |

OTHER PUBLICATIONS

Young, Lee W., "International Search Report" for PCT/US12/31525 as mailed Sep. 21, 2012, 7 pages.

*Primary Examiner* — Sang Kim
*Assistant Examiner* — Juan Campos, Jr.
(74) *Attorney, Agent, or Firm* — Winstead PC

(57) ABSTRACT

The present invention relates to a system for lifting and manipulating a load. The system includes a gantry crane having a support rail, a support gantry, and a gantry beam connected to and traversing a space between the support rail and the support gantry. The gantry crane also includes a trolley disposed with the gantry beam. The system further includes a lifting platform secured to a top surface of the gantry beam, and a lifting device disposed with the lifting platform.

8 Claims, 9 Drawing Sheets

(56) References Cited

U.S. PATENT DOCUMENTS

| | | | | |
|---|---|---|---|---|
| 4,360,112 | A | 11/1982 | Brewer et al. | |
| 4,360,304 | A | 11/1982 | Brewer et al. | |
| 4,459,078 | A * | 7/1984 | Chiantella et al. | 414/279 |
| 4,561,551 | A | 12/1985 | Goussinsky | |
| 6,543,605 | B2 | 4/2003 | Faitel | |
| 7,503,460 | B1 | 3/2009 | Petricio Yaksic | |
| 7,546,929 | B2 | 6/2009 | Wierzba et al. | |
| 2008/0219804 | A1 | 9/2008 | Chattey | |
| 2008/0265227 | A1 | 10/2008 | May | |
| 2010/0239371 | A1 | 9/2010 | Brown | |

* cited by examiner

| | NO LIFTING DEVICE | | |
|---|---|---|---|
| | NO LIFTING DEVICE CARRIER NEAR A | NO LIFTING DEVICE CARRIER AT END | NO LIFTING DEVICE CARRIER AT END AND NO LOAD |
| RA | 60.0 | 20.0 | 25.0 |
| RB | 50.0 | 90.0 | 60.0 |
| RC | 0.0 | 0.0 | 0.0 |
| RD | 0.0 | 0.0 | 0.0 |
| TOTAL | 110.0 | 110.0 | 85.0 |
| | | | |
| RA + RC | 60.0 | 20.0 | 25.0 |
| TROLLEY LOAD | 40.0 | 40.0 | 15.0 |

FIG. 7A

| WITH LIFTING DEVICE | | |
|---|---|---|
| WITH LIFTING DEVICE - 40Te CLOSE | WITH LIFTING DEVICE - 40Te FAR | WITH LIFTING DEVICE - LIGHT LOAD |
| 43.0 | 54.4 | 30.0 |
| 67.7 | 72.6 | 62.2 |
| 28.3 | 12.0 | 9.8 |
| 25.7 | 42.0 | 7.2 |
| 139.0 | 139.0 | 102.0 |
| | | |
| 71.3 | 66.4 | 39.9 |
| 15.0 | 16.0 | 15.0 |

FIG. 7B

METHOD AND SYSTEM FOR LIFTING AND MANIPULATING A LOAD

CROSS-REFERENCE TO RELATED APPLICATIONS

This application claims priority to, and incorporates by reference for any purpose the entire disclosure of, U.S. Provisional Patent Application No. 61/470,600, filed on Apr. 1, 2011.

BACKGROUND

Field of the Invention

The present invention relates generally to methods and systems for lifting and manipulating loads. More particularly, but not by way of limitation, the present invention relates to methods and systems for utilizing a gantry crane and rail system to safely lift more than a rated capacity of the gantry crane.

History of the Related Art

Cranes are frequently used in activities such as, for example, construction, manufacturing, mining, and refining to lift and manipulate heavy objects. In particular, gantry cranes, bridge cranes, and overhead cranes are examples of cranes that lift objects via, for example, a hoist secured to a hoist trolley. The hoist trolley moves along a rail or pair of rails that are affixed to a beam. In overhead cranes and bridge cranes, ends of the beam include wheels that engage rails. The beam typically traverses a working space such as, for example, an interior of a factory or similar industrial building. In contrast, the beam of a gantry crane is supported by one or more upright support gantries. The support gantries are often mounted on wheels thereby allowing the gantry crane to traverse a working area such as, for example, a rail yard or a dry dock. In cases where the loads to be lifted are easily moved, such as, for example, in a rail yard, the support gantries may be fixed to the ground.

All cranes, and particularly gantry cranes, are designed with a maximum-safe-load capacity. Exceeding the maximum-safe-load capacity carries risk of damage to the cranes and the surrounding structures as well as risk of personal injury and loss of insurance coverage. However, in large projects such as, for example, construction, mining, and refining it is often necessary to lift loads exceeding the maximum-safe-load capacity of an available gantry crane. In such situations, gantry cranes are often supplemented with one or more mobile cranes to increase an effective maximum-safe-load capacity. However, use of mobile cranes typically requires construction of a suitable foundation. Furthermore, space constraints in an area surrounding a construction site, a mine, or a refinery often render the use of mobile cranes infeasible.

SUMMARY

In one aspect, the present invention relates to a system for lifting and manipulating a load. In various embodiments, the system may include a gantry crane having a support rail, a support gantry, and a gantry beam coupled to the support rail and the support gantry. A lifting platform is secured to the gantry beam. The lifting platform includes a substantially-vertical portion that engages the support rail. A lifting device is disposed with the lifting platform. At least a portion of a load supported by the lifting device is transmitted, via the substantially-vertical portion, to the support rail thereby effectively increasing a safe lifting capacity of the gantry crane.

In another aspect, the present invention relates to a method for enabling loads greater than a safe working load of a gantry crane to be lifted without exceeding a safe working load of the components of the gantry crane. In various embodiments, the method may include providing a gantry crane having a support rail, a support gantry, and a gantry beam connected to the support rail and the support gantry. The method may further include locating a lifting platform on a top surface of the gantry beam such that a substantially-vertical portion of the lifting platform engages the support rail. The method may further include loading the lifting platform with a load and transmitting at least a portion of the load to the support rail via the substantially-vertical portion thereby effectively increasing a safe lifting capacity of the gantry crane.

In another aspect, the present invention relates to a method for lifting an object. In various embodiments, the method may include connecting a first lifting cable to a first corner of a lifting frame, connecting a second lifting cable to a second corner of the lifting frame, and connecting a load to a third corner of the lifting frame. The method may further include lifting the load, via the first lifting cable and the second lifting cable, rotating the lifting frame to position the load underneath the first lifting cable, disconnecting the second lifting cable, and manipulating the load with the first lifting cable.

BRIEF DESCRIPTION OF THE DRAWINGS

For a more complete understanding of the present invention and for further objects and advantages thereof, reference may now be had to the following description taken in conjunction with the accompanying drawings in which:

FIGS. 7A-7B are tables illustrating magnitudes of reaction forces associated with various gantry-crane loading scenarios according to an exemplary embodiment;

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
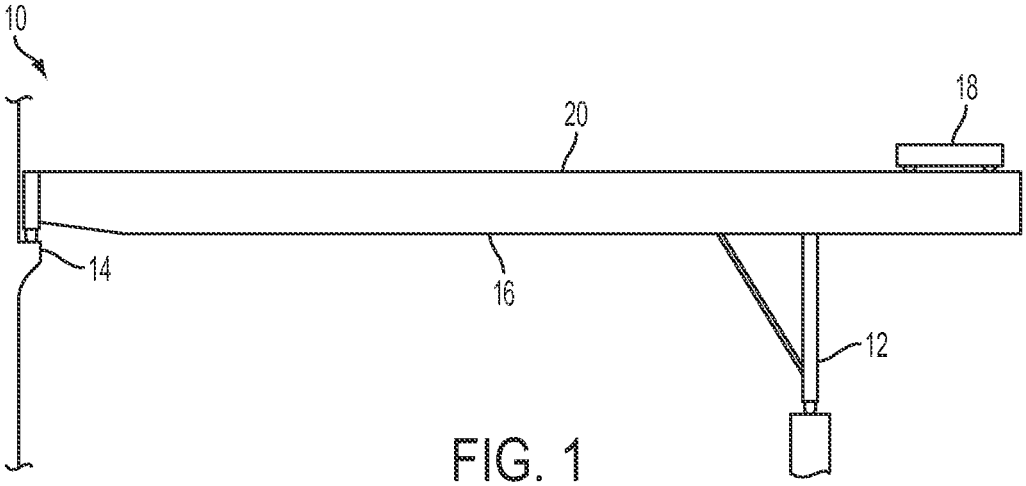
FIG. 1 PRIOR ART
FIG. 1 is a side elevation view of a prior-art gantry crane.

FIG. 1 is a side elevation view of a prior-art gantry crane. A gantry crane 10 typically includes a support gantry 12, a support rail 14, and a gantry beam 16 disposed between, and operatively coupled to, the support gantry 12 and the support rail 14. A trolley 18 is mounted on the gantry beam 16. The trolley 18 is typically free to traverse substantially an entire length of the gantry beam 16. The trolley 18 may be secured to either a top surface or a bottom surface of the gantry beam 16. Tracks 20 are mounted to the gantry beam 16 to guide the trolley 18.

Still referring to FIG. 1, a lifting device (not shown) is mounted to the trolley 18. During operation, the lifting device is connected to a load (not shown). The load is supported by, and is distributed equally across, the gantry beam 16. As will be discussed in more detail hereinbelow, the gantry beam 16 is supported by reaction forces transmitted through the support gantry 12 and the support rail 14. Thus, when the lifting device lifts, for example, a 40 ton load, the 40 ton load is supported by both the support gantry 12 and the support rail 14. The precise amount of the 40 ton load that is supported by the support gantry 12 or the support rail 14 varies depending on a position of the trolley 18.

Figure 2A:
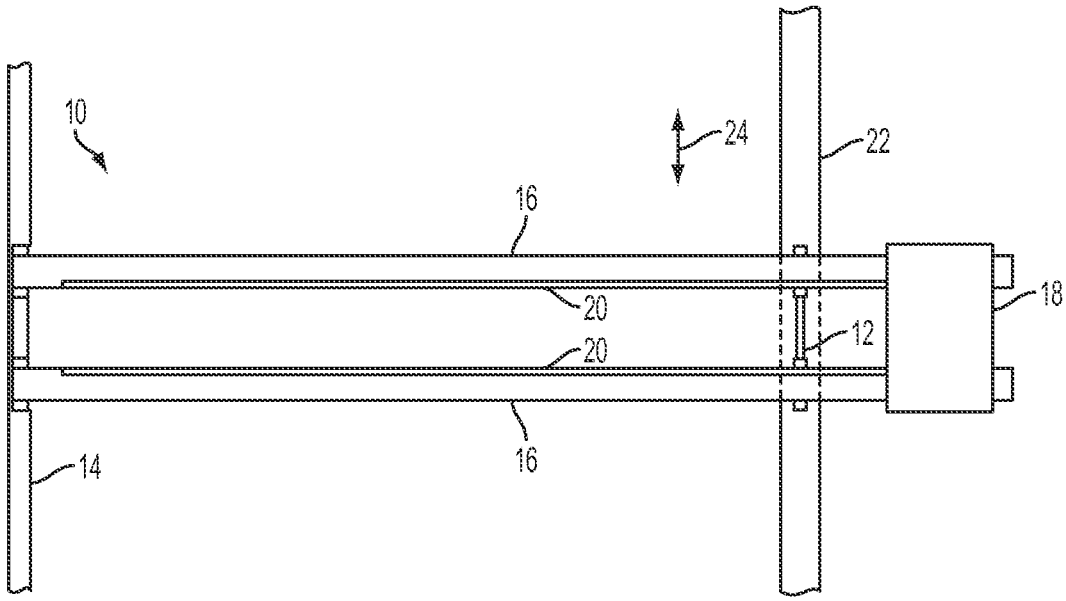
FIG. 2A PRIOR ART
FIG. 2A is a top plan view of the prior-art gantry crane of FIG. 1.

FIG. 2A is a top plan view of the prior-art gantry crane of FIG. 1. The gantry crane 10 may include more than one gantry beam 16. By way of example, the arrangement illustrated in FIG. 2A is shown to have two gantry beams 16. The support gantry 12 engages a track 22 and traverses a length of the track 22 and the support rail 14 in a direction illustrated by the arrows 24.

Figure 2B:
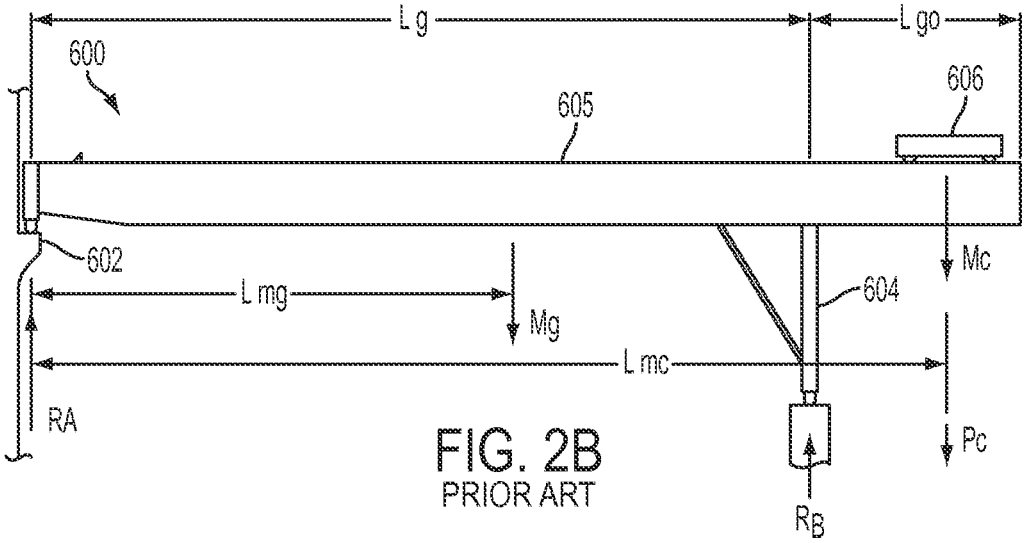
FIG. 2B PRIOR ART
FIG. 2B is a force diagram of a prior-art gantry crane.

FIG. 2B is a force diagram of a prior-art gantry crane. In FIG. 2B, various dimensions and forces associated with a prior-art gantry crane 600 are illustrated. Dimension Lg represents a distance between a support rail 602 and a support gantry 604. Dimension Lgo represents a distance that a gantry beam 605 is cantilevered outside the support gantry 604. Dimension Mg represents a mass of the gantry crane 600. Dimension Mc represents a mass of a trolley 606. Dimension Lmg is a fixed dimension that represents a distance between the support rail 602 and a center of gravity of the gantry crane 600. Dimension Lmc is a variable dimension that represents a distance between the support rail 602 and a center of gravity of the trolley 606. A value Pc represents a load borne by the gantry crane 600. Values Ra and Rb represent reaction forces transmitted through the support rail 602 and the support gantry 604, respectively.

Figure 3:
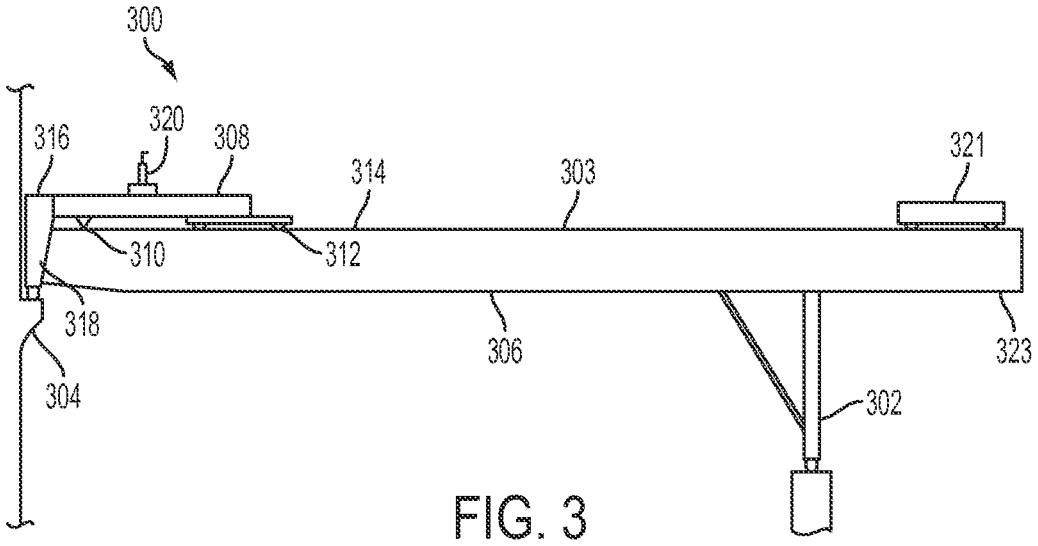
FIG. 3 is a side elevation view of a gantry crane according to an exemplary embodiment.

FIG. 3 is a side elevation view of a gantry crane according to an exemplary embodiment. A gantry crane 300 includes a support gantry 302, a support rail 304, and a gantry beam 306 disposed between, and operatively coupled to, the support gantry 302 and the support rail 304. A lifting platform 308 is positioned on a top surface 303 of the gantry beam 306 near the support rail 304. At least one rail stop 310 is affixed to the top surface 303 of the gantry beam 306. The lifting platform 308 is coupled to the at least one rail stop 310 by way of a connection such as, for example, welding, bolting, or the like. A plurality of wheels 312 are positioned on an underside of the lifting platform 308. In a typical embodiment, the plurality of wheels 312 are positioned to engage a rail 314 disposed on the top surface 303 of the gantry beam 306. A substantially-vertical portion 316 of the lifting platform 308 wraps around an end 318 of the gantry beam 306 and engages the support rail 304. A lifting device 320 is positioned on a top surface of the lifting platform 308. During operation, a load (not shown) supported by the lifting device 320 is transmitted directly to the support rail 304 via the substantially-vertical portion 316 thereby substantially reducing a portion of the load that is supported by the gantry beam 306. In a typical embodiment, the lifting device 320 may be, for example, a strand jack, a winch, or other appropriate lifting device. The trolley 321 includes a plurality of wheels (not shown) that engage the rail 314. A trolley 321 is positioned on a portion 323 of the gantry beam 306 that is cantilevered past the support gantry 302. In a typical embodiment, the trolley 321 acts as a counterweight to reduce a magnitude of reaction forces transmitted through the support rail 304. In other embodiments, the trolley 321 may be omitted.

Figure 4:
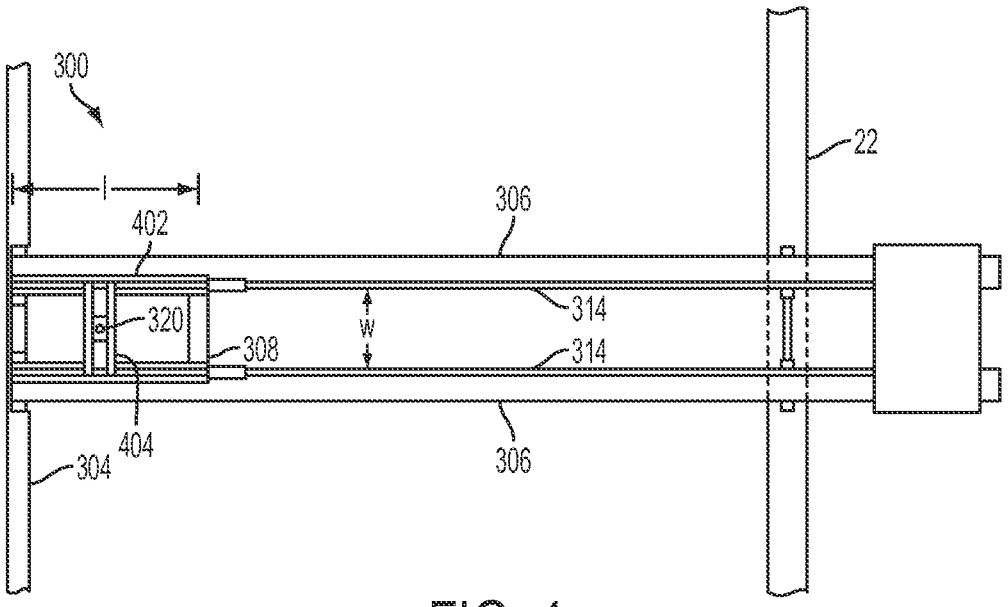
FIG. 4 is a top plan view of the gantry crane of FIG. 3 according to an exemplary embodiment.

FIG. 4 is a top plan view of the gantry crane of FIG. 3 according to an exemplary embodiment. By way of example, the gantry crane 300 is shown in FIG. 4 as including two gantry beams 306; however, one skilled in the art will recognize that, in other embodiments, gantry cranes utilizing principles of the invention may include any appropriate number of gantry beams 306. The rail 314 is positioned on a top surface of the two gantry beams 306 and spans a length of the two gantry beams 306. The lifting platform 308 engages the rail 314 and is positioned to span a distance (w) between adjacent gantry beams 306.

Still referring to FIG. 4, the lifting device 320 includes at least one longitudinal member 402 oriented generally parallel to the gantry beams 306. A bridge member 404 is coupled to the at least one longitudinal member 402 and is arranged generally orthogonally to the at least one longitudinal member 402. The lifting device 320 is coupled to the bridge member 404. In a typical embodiment, the lifting device 320 traverses the distance (w) between the adjacent gantry beams 306. Furthermore, in a typical embodiment, the bridge member 404 is capable of traversing a length (l) of the lifting platform 308.

Figure 5:
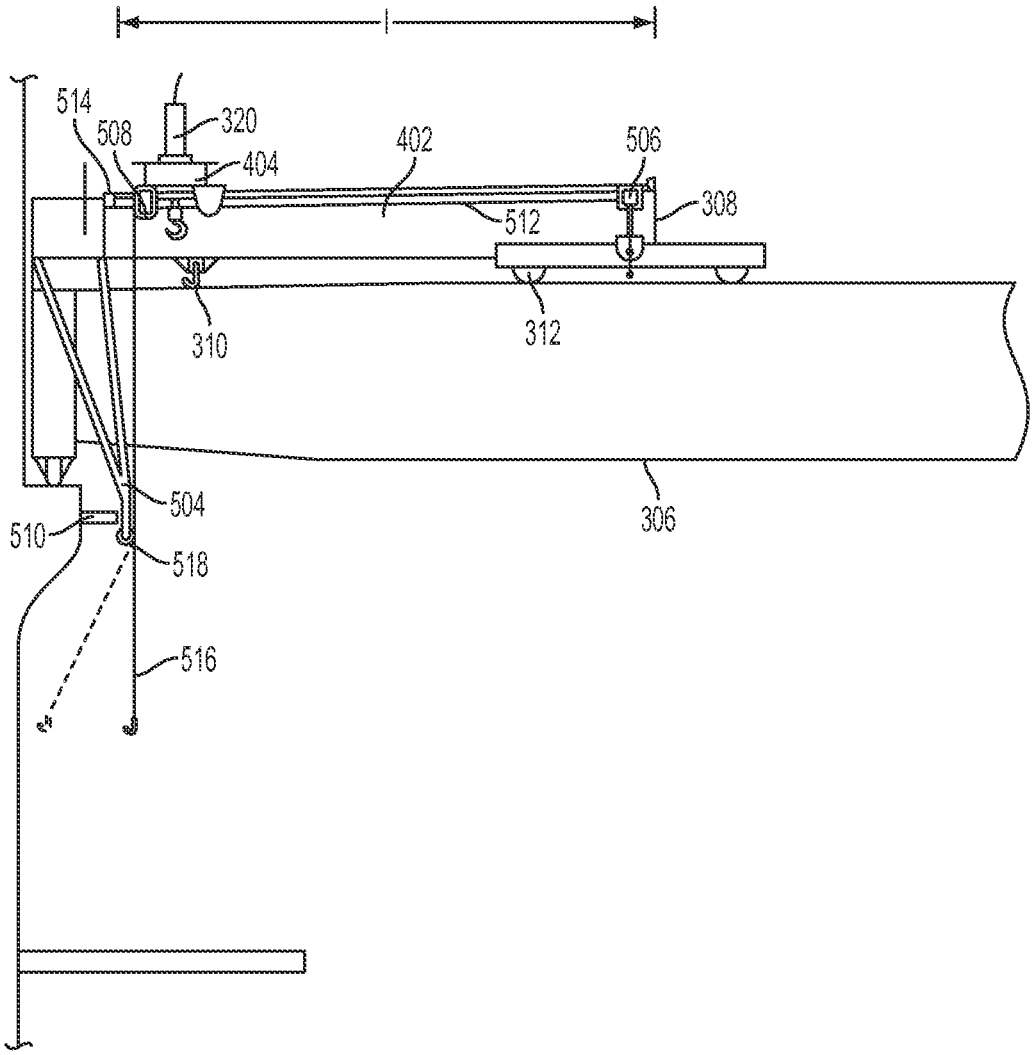
FIG. 5 is an enlarged side elevation view of a lifting platform according to an exemplary embodiment.

FIG. 5 is a side elevation view of a lifting platform according to an exemplary embodiment. The at least one longitudinal member 402 is connected at a first end to the at least one rail stop 310. A second end of the at least one longitudinal member 402 includes the plurality of wheels 312. The plurality of wheels engage the rail 314 (shown in FIG. 4). The bridge member 404 is positioned substantially orthogonal to the at least one longitudinal member 402. The lifting device 320 is positioned on the bridge member 404.

Still referring to FIG. 5, the lifting platform 308 includes a guard 504, a positioning winch 506, and at least one auxiliary lifting winch 508. The positioning winch 506 includes a cable 512 and a pulley 514. During operation, the positioning winch 506 moves the bridge member 404 along a length (l) of the at least one longitudinal member 402.

Still referring to FIG. 5, the lifting device 320 is powered via contact with a power supply 510. In a typical embodiment, the power supply 510 is an exposed electrified conductor such as, for example, a bus bar, an exposed wire, or other current-carrying device. Any contact between a lifting cable 516 and the power supply 510 carries severe risk of personal injury and equipment damage. The guard 504 extends from an underside of the lifting platform 308 between adjacent gantry beams 306 to a point below the power supply 510. A pulley 518 is mounted to a distal end of the guard 504. During operation, the guard 504 prevents the lifting cable 516 from contacting the power supply 510. The pulley 518 allows the lifting cable 516 to be redirected to a region directly underneath the power supply 510 without risk of damage to the lifting cable 516 or the guard 504.

Figure 6:
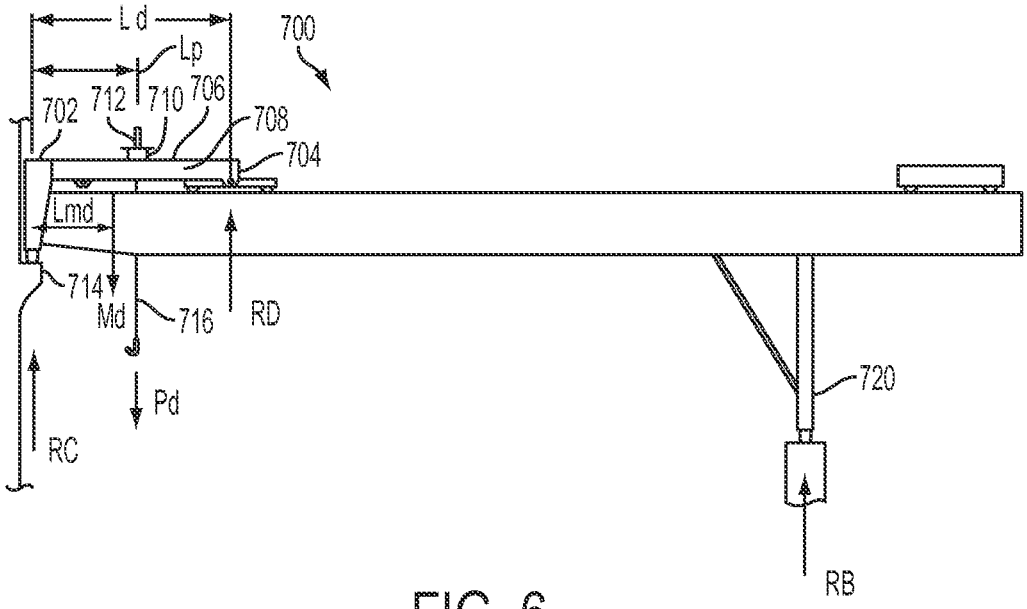
FIG. 6 is a force diagram of a gantry crane according to an exemplary embodiment.

FIG. 6 is a force diagram of a gantry crane according to an exemplary embodiment. In FIG. 6, various dimensions and forces associated with a gantry crane 700 are illustrated according to a typical embodiment. In contrast to FIG. 2B, the gantry crane 700 includes a lifting platform 706. Dimension Ld represents a distance between a first support 702 and a second support 704 of the lifting platform 706. Dimension Md represents a mass of the lifting platform 706. Dimension Lmd is a fixed dimension that represents a distance between a support rail 714 and a center of gravity of the lifting platform 706. Dimension Lp is a variable dimension that represents a distance between the support rail 714 and a center of gravity of a load supported by the lifting platform 706. A value Pd represents a load supported by a main hook 716 of the lifting device 712. Values Rc and Rd represent reaction forces supported by the first support 702 and the second support 704, respectively. A value Rb represents a reaction force supported by a support gantry 720. Thus, the gantry crane 700 distributes the load Pd to at least one of the support rail 714 and the support gantry 720 thereby allowing the gantry crane 700 to lift loads greater than a safe working load of the gantry crane 700.

FIG. 7A is a table illustrating magnitudes of reaction forces associated with a prior-art gantry crane. In particular, FIG. 7A summarizes reaction forces exhibited in various loading scenarios of a prior-art gantry crane such as, for example, the gantry crane 600. By way of example, when lifting a 40 ton load, the gantry crane 600 exhibits a total reaction force of 110 tons.

FIG. 7B is a table illustrating magnitudes of reaction forces associated with a gantry crane according to an exemplary embodiment. In particular, FIG. 7B summarizes reaction forces associated with various loading scenarios of a gantry crane such as, for example, the gantry crane 700. By way of example, when lifting a 15 ton load, the gantry crane 700 exhibits a total reaction force of 139 tons. Thus, as illustrated, in FIG. 7B, addition of the lifting platform 706 effectively increases a effective safe lifting capacity of the gantry crane 700. Loading on the support rail 714 and the support gantry 720 is less than a maximum design load despite the fact that the load Pd may exceed the safe working load of the gantry crane 700.

Figure 7C:
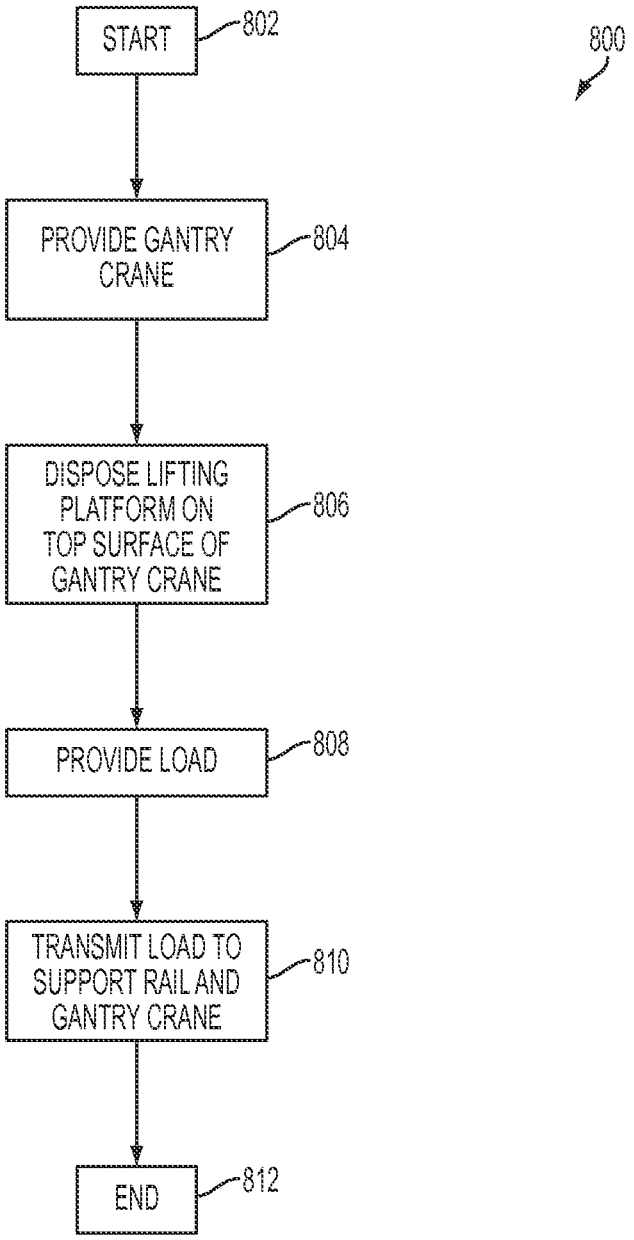
FIG. 7C is a flow diagram illustrating a method for lifting a load.

FIG. 7C is a flow diagram illustrating a process for lifting a load. A process 800 begins at step 802. At step 804, the gantry crane 300 is provided having a support rail 304, a support gantry 302, and a gantry beam 306 disposed between the support rail 304 and the support gantry 302. At step 806, a lifting platform 308 is disposed on a top surface of the gantry beam such that a substantially-vertical portion 316 of the lifting platform engages the support rail 304. At step 808, a load is provided to be lifted by the gantry crane 300. At step 810, a portion of the load is transmitted to the support rail 304 via the substantially-vertical portion 316 thereby increasing a safe lifting capacity of the gantry crane 300.

Figures 8A, 8B, 8C:
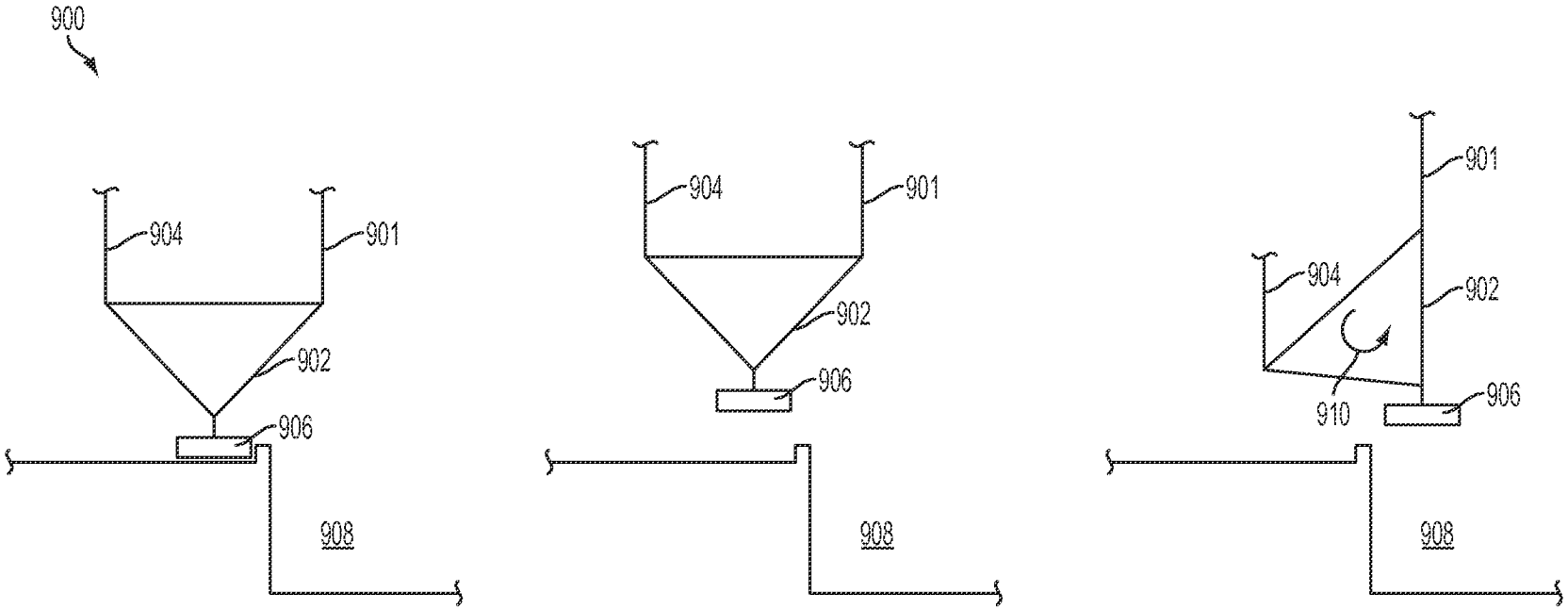
FIGS. 8A-8C are sequential schematic drawings illustrating a method for manipulating a load where a single lifting cable cannot be place directly over the load according to an exemplary embodiment.

FIGS. 8A-8C are sequential schematic drawings illustrating a method for manipulating a load according to an exemplary embodiment. A manipulating system 900 includes a lifting cable 901, a lifting frame 902, and an auxiliary lifting cable 904. The lifting cable 901 is associated with a lifting device (not shown) such as, for example the lifting device 320 (shown in FIG. 3) and the auxiliary lifting cable 904 is associated with a second lifting device (not shown) such as, for example a mobile crane. As shown in FIGS. 8A-8C, the lifting frame 902 is triangular; however, one skilled in the art will recognize that, in other embodiments, lifting frames having any appropriate shape may be utilized in accordance with design requirements. The lifting frame 902 is connected to a load 906.

As shown in FIG. 8A, the load 906 is initially positioned near an edge of a pit 908. In a typical embodiment, a gantry crane (not shown) such as, for example, the gantry crane 300 (shown in FIGS. 3 and 4) spans the pit 908. The lifting device is moved as close to the edge of the pit 908 as possible. However, as illustrated in FIG. 8A, in some cases the lifting device will not be capable of sufficient travel to position the lifting cable 901 directly over the load 906. The lifting cable 901 is connected to a first corner of the lifting frame 902. The auxiliary lifting cable 904 is connected to a second corner of the lifting frame 902 and the load 906 is connected to a third corner of the lifting frame 902.

As shown in FIG. 8B, during operation, the lifting cable 901 and the auxiliary lifting cable 904, working in tandem, lift the load 906. In a typical embodiment, during initial lifting, the load 906 is lifted in a substantially vertical direction.

As shown in FIG. 8C, when the load 906 reaches a sufficient height, the auxiliary lifting cable 904 ceases lifting while the lifting cable 901 continues lifting. This causes the lifting frame 902 to rotate in a direction illustrated by the arrow 910. Such rotation moves the load 906 in a lateral direction. The lifting frame 902 continues to rotate until the load 906 is positioned directly underneath the lifting cable 901. When the load 906 is positioned directly underneath the lifting cable 901, the auxiliary lifting cable 904 is disconnected and the load is lifted and positioned by the lifting cable 901.

Figure 9:
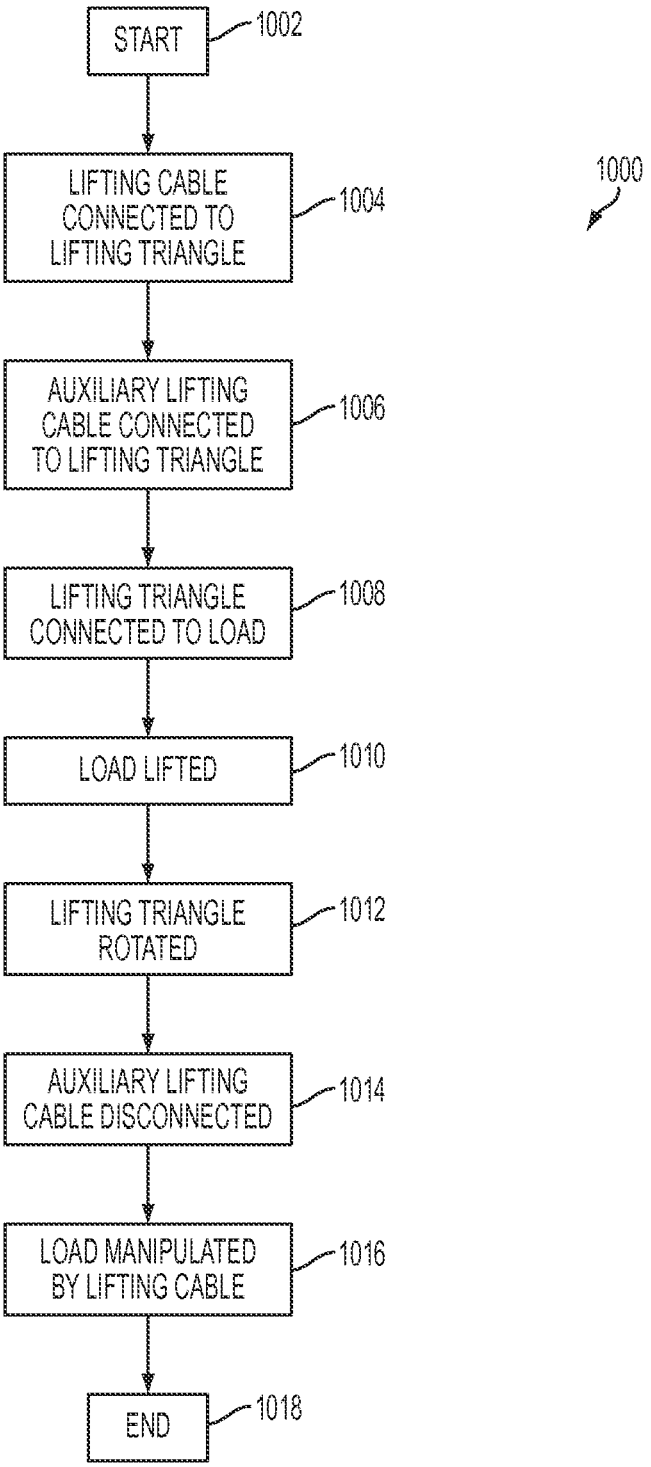
FIG. 9 is a flow diagram illustrating a method for lifting and manipulating a load according to an exemplary embodiment.

FIG. 9 is a flow diagram illustrating a method for lifting and manipulating a load according to an exemplary embodiment. A process 1000 starts at step 1002. At step 1004 a lifting cable 901 is connected to a lifting frame 902. At step 1006, an auxiliary lifting cable 904 is connected to the lifting frame 902. At step 1008, the lifting frame 902 is connected to a load 906 positioned near an edge of a pit 908. At step 1010, the load 906 is lifted by the lifting cable 901 and the auxiliary lifting cable 904. At step 1012, the lifting frame 902 is rotated until the load 906 is directly underneath the lifting cable 901. At step 1014, the auxiliary lifting cable 904 is disconnected from the lifting frame 902. At step 1016, the load 906 is lifted by the lifting cable 901. The process 1000 ends at step 1018.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

What is claimed is:

1. A system for lifting and manipulating a load, the system comprising:

a gantry crane comprising:

a support rail;

a support gantry; and a gantry beam having a first end and a second end, the first end being coupled to the support rail and the second end being coupled to the support gantry;

a lifting platform secured to the gantry beam, wherein the lifting platform includes a substantially-vertical portion that wraps around the first end of the gantry beam and engages the support rail;

a lifting device disposed with the lifting platform; and wherein, at least a portion of the load is transmitted, via the substantially-vertical portion, to the support rail thereby increasing a safe lifting capacity of the gantry crane.

2. The system of claim 1, further comprising:

a power supply disposed proximate to the support rail; and a guard coupled to the lifting platform and extending below the power supply, wherein the guard prevents contact between a lifting cable and the power supply.

3. The system of claim 2, further comprising a pulley coupled to a bottom region of the guard.

4. The system of claim 2, wherein the power supply is a bus bar.

5. The system of claim 1, wherein the lifting platform comprises:

a longitudinal member; and a bridge member positioned substantially orthogonal to the longitudinal member.

6. The system of claim 5, wherein the lifting device is coupled to the bridge member.

7. The system of claim 6, further comprising a positioning winch, wherein the positioning winch moves the bridge member along a length of the longitudinal member.

8. The system of claim 5, further comprising an auxiliary lifting winch coupled to the lifting platform.

* * * * *